US005911596A

United States Patent [19]

Antonuccio et al.

[11] Patent Number: 5,911,596

[45] Date of Patent: Jun. 15, 1999

[54] STRAIN RELIEF APPARATUS AND METHODS THEREFOR

[75] Inventors: Robert S. Antonuccio, Burlington; David E. Desilets, Hopkinton; Joseph M. Spano, North Reading; Mathew J. Palazola, Glochester, all of Mass.; William A. Izzicupo, Windham, N.H.; James M. Carney, Pepperell, Mass.; Daniel D. Gonsalves, Hudson, N.H.; Mark R. Pugliese, Shrewsbury, Mass.

[73] Assignee: Sun Microsystems, Inc., Palo Alto, Calif.

[21] Appl. No.: 08/794,809

[22] Filed: Feb. 4, 1997

[51] Int. Cl.[6] ..... H01R 9/07

[52] U.S. Cl. ..... 439/493; 439/449

[58] Field of Search ..... 439/493, 449, 439/459, 470

[56] References Cited

U.S. PATENT DOCUMENTS

| | | | |
|---|---|---|---|
| 4,139,727 | 2/1979 | Kuballa | 439/493 |
| 4,955,814 | 9/1990 | Christie et al. | 439/449 |
| 5,344,338 | 9/1994 | Colleran et al. | 439/493 |
| 5,462,451 | 10/1995 | Yeh | 439/493 |

FOREIGN PATENT DOCUMENTS

| | | | |
|---|---|---|---|
| 2441559 | 3/1976 | Germany | 439/493 |
| 3405126 | 8/1985 | Germany | 439/493 |
| 0243384 | 9/1989 | Japan | 439/493 |

*Primary Examiner*—Gary Paumen
*Assistant Examiner*—Tho Dac Ta
*Attorney, Agent, or Firm*—Beyer & Weaver, LLP

[57] ABSTRACT

An apparatus for securing a conductor to a circuit board. The conductor is configured for being soldered to the circuit board through a first aperture in the board. The apparatus includes a conductor supporting portion having a second aperture therethrough. The conductor supporting portion is configured for coupling to the circuit board. The second aperture substantially aligns with the first aperture when the conductor supporting portion is coupled to the circuit board to permit the conductor to be inserted through both the first aperture and the second aperture. The apparatus includes a tab portion configured for coupling to the conductor supporting portion. A portion of the conductor is thus held substantially immobile between the conductor supporting portion and a first edge of the tab portion when the tab portion is coupled with the conductor supporting portion, thereby preventing the conductor from being broken at the portion of the conductor when the conductor is flexed.

19 Claims, 6 Drawing Sheets

STRAIN RELIEF APPARATUS AND METHODS THEREFOR

BACKGROUND OF THE INVENTION

The present invention relates to techniques for attaching conductors to a circuit board. More particularly, the invention relates to methods and apparatus for improved attachment of a conductor to a circuit board, which advantageously reduces conductor breakage during use.

Circuit boards have long been employed in electronic equipments, e.g., computers. In a typical computer, for example, there may be one or more circuit boards on which a variety of digital and analog components may be mounted. One or more conductors may be employed to supply power, data, and the like to each circuit board. To facilitate discussion, FIG. 1 is a prior art illustration of a typical circuit board 100. Circuit board 100 may include any variety of analog and digital components, and may be employed as, for example, a power distribution board, a logic board, or the like.

Power and data may be supplied to circuit board 100 via any number of conductors. By way of example, there are shown in FIG. 1 conductors 102(*a*) and 102(*b*), which may be employed to supply for example +5 V and ground to circuit board 100. Electrical considerations may require conductors 102 to assume a variety of sizes and shapes, including flat bands. For good electrical conductivity, conductors 102(*a*) and 102(*b*) may be formed of a highly conductive metal such as copper, aluminum, an alloy thereof, or the like.

Conductors 102(*a*) and 102(*b*) may be inserted into apertures in the board, e.g., respective apertures 104(*a*) and 104(*b*), to permit conductors 102(*a*) and 102(*b*) to be subsequently soldered to circuit board 100. Soldering may be accomplished as circuit board 100, including conductors 102(*a*) and 102(*b*) disposed in apertures 104(*a*) and 104(*b*), is passed through a solder wave machine.

In some solder wave systems, for example, circuit board 100 may be passed over a pool of molten solder material, e.g., lead or an alloy thereof, to permit the molten solder material adhere to conductor leads and component leads which protruded out of the underside of the board. The adhered solder material, after solidifying, solders the leads of conductors and components to their respective apertures.

While the above technique adequately insures that conductors be securely soldered to its circuit board during manufacturing, it has been found that the heat of the soldering operation renders some conductors brittle near the solder point, e.g., near aperture 104 in the illustration of FIG. 1. This brittle portion renders the soldered conductor susceptible to breakage when the board is handled during use and the conductor is flexed, e.g., in the subsequent steps of the manufacturing process, during shipping, installation, or the like.

The conductor breakage problem is particularly acute for boards whose conductors are frequently flexed by plugging and unplugging, e.g., for maintenance and update of those boards themselves or of other boards to which the soldered conductors are attached. If the soldered conductors are attached to a power distribution board, for example, the soldered conductors may be expected to be plugged and unplugged numerous times during its lifetime as boards to which the soldered conductors are attached, e.g., other circuit boards in the system, are installed, removed, and/or reinstalled. As can be appreciated from the foregoing, conductor breakage may shorten the useful life of the board to which the conductor is soldered, necessitating expensive and time consuming repair and/or replacement.

In view of the foregoing, there are desired apparatus and methods for reducing breakage in soldered conductors, particularly those that may be frequently flexed during manufacturing, installation, and use.

SUMMARY OF THE INVENTION

The invention relates, in one embodiment, to an apparatus for securing a conductor to a circuit board. The conductor is configured for being soldered to the circuit board through a first aperture in the board. The apparatus includes a conductor supporting portion having a second aperture therethrough. The conductor supporting portion is configured for coupling to the circuit boar. The second aperture substantially aligns with the first aperture when the conductor supporting portion is coupled to the circuit board to permit the conductor to be inserted through both the first aperture and the second aperture. The apparatus includes a tab portion configured for coupling to the conductor supporting portion. A portion of the conductor is thus held substantially immobile between the conductor supporting portion and a first edge of the tab portion when the tab portion is coupled with the conductor supporting portion, thereby preventing the conductor from being broken at the portion of the conductor when the conductor is flexed.

In another embodiment, the invention relates to a method for reducing breakage to a conductor when the conductor is flexed. The conductor is configured for being soldered to a circuit board through a first aperture in the circuit board. The method includes coupling a conductor supporting portion to the circuit board. The conductor supporting portion has a second aperture therethrough. The second aperture substantially aligns with the first aperture when the conductor supporting portion is coupled to the circuit board.

The method includes inserting the conductor through the first aperture and the second aperture. The method further includes coupling a tab portion to the conductor supporting portion. A portion of the conductor is thus held substantially immobile between the conductor supporting portion and a first edge of the tab portion when the tab portion is coupled with the conductor supporting portion, thereby preventing the conductor from being broken at the portion of the conductor when the conductor is flexed.

In yet another embodiment, the invention relates to an apparatus for securing a conductor to a circuit board. The conductor is configured for being soldered to the circuit board through a first aperture in the circuit board. The apparatus includes first conductor support means having a second aperture therethrough. The second aperture substantially aligns with the first aperture when the first conductor support means is coupled to the circuit board. The apparatus further includes second conductor support means configured for coupling to the first conductor support means. A portion of the conductor is thus held substantially immobile between the second conductor support means and a first edge of the second conductor support means when the second conductor support means is coupled with the first conductor supporting means, thereby preventing the conductor from being broken at the portion of the conductor when the conductor is flexed.

These and other advantages of the present invention will become apparent upon reading the following detailed descriptions and studying the various figures of the drawings.

DETAILED DESCRIPTION OF THE PREFERRED EMBODIMENTS

In accordance with one aspect of the present invention, there is provided an inventive strain relief apparatus for substantially immobilizing at least a portion of the brittle portion of a soldered conductor. Once immobilized, the brittle portion is prevented from flexing during use, even as the reset of the conductor is flexed, thereby reducing the potentiality for conductor breakage.

In one embodiment, the strain relief apparatus includes two portions, a base portion and a tab portion. The base is configured for coupling to the circuit board and includes a conductor support for supporting a portion of the conductor, e.g., the brittle portion. The tab portion is then mated with the conductor support to capture the brittle portion therebetween. Once captured between the tab and the conductor support of the base, the brittle portion is substantially immobilized, even as the rest of the conductor is flexed.

In another embodiment, the strain relief apparatus is arranged and/or formed of a suitable material to permit the strain relief apparatus to withstand the heat of the soldering process. If the conductor is properly positioned relative to the circuit board while being immobilized by the inventive strain relief apparatus, the entire assembly may be passed through a wave solder system. In this case, the inventive strain relief apparatus advantageously functions as a wave solder fixture, e.g., a device for ensuring that the conductor leads remain properly positioned during soldering. After soldering, the inventive "fixture" may be left on the circuit board to permit the inventive "fixture" to accomplish its strain relief function in subsequent stages of the manufacturing process, during installation and use.

Figure 1:
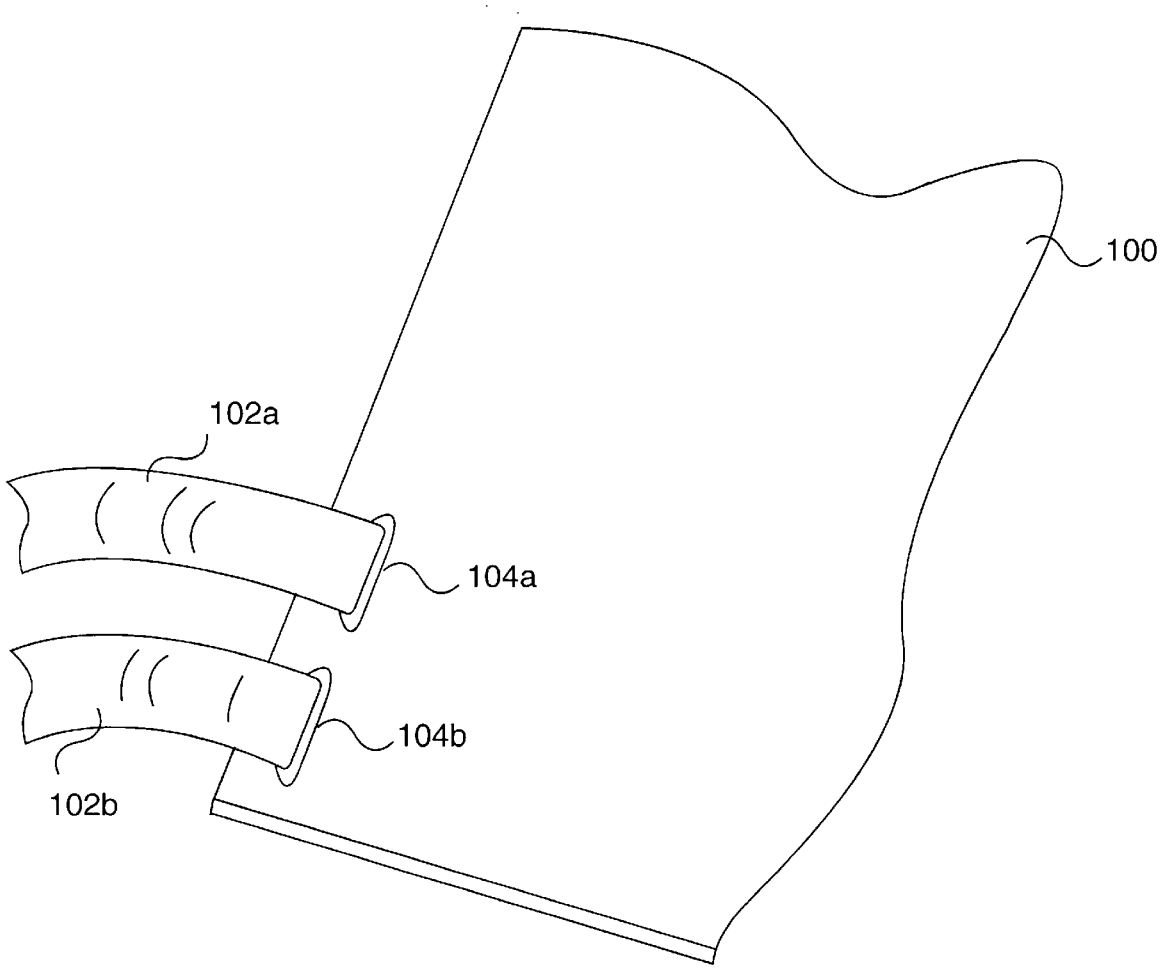
FIG. 1 (Prior Art)
FIG. 1 is a prior art illustration of a typical circuit board 100, including conductors soldered thereto.
Figure 2:
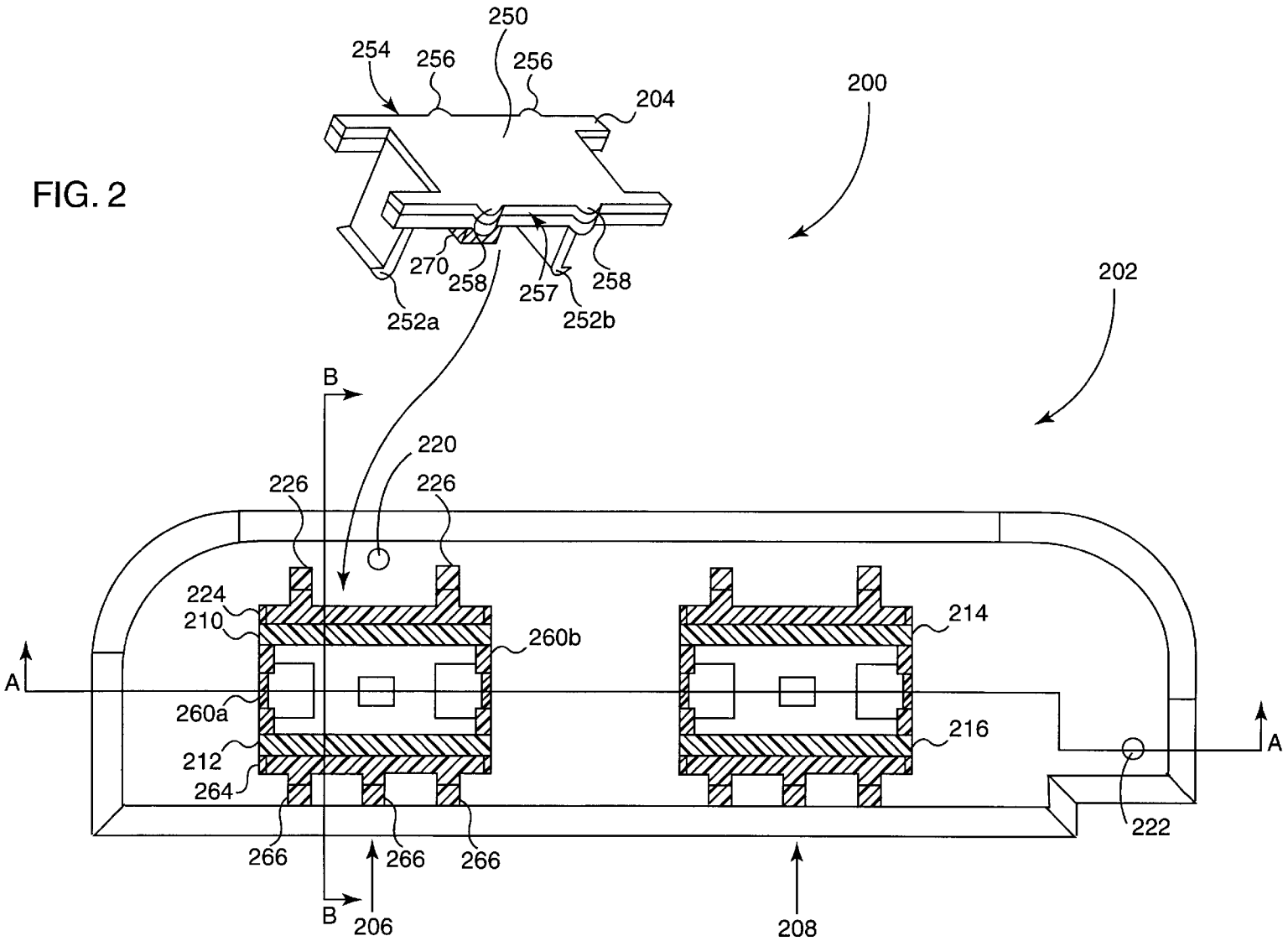
FIG. 2 depicts, in accordance with one embodiment, the inventive strain relief apparatus including a base portion and a tab portion.

To further illustrate the foregoing, FIG. 2 depicts, in accordance with one embodiment, a strain relief apparatus 200, including a base 202 and a tab 204. Base 202, which is viewed from the top, is configured for being attached to the top surface of a circuit board (omitted from FIG. 2 to improve clarity). Base 202 includes two conductor supports 206 and 208. Conductor support 206 includes two apertures 210 and 212 for accommodating two conductors (in the shape of two thin bands and omitted from FIG. 2 to improve clarity). Likewise, conductor support 208 includes two apertures 214 and 216 for accommodating two additional conductors (also omitted from FIG. 2 to improve clarity).

Although there are shown in base 202 two conductor supports, each of which includes two apertures (for accommodating a total of four conductors) it is contemplated that base 202 may include a single conductor support, which may have only a single aperture for accommodating only one conductor. For simplicity of illustration, the below discussion is made with reference to only conductor support 206, and particularly to aperture 210 of conductor support 206. It should be borne in mind, however, that there is no limit to the number of apertures per conductor support, or the number of conductor supports per base. In one embodiment, base 202, including conductor support 206, and conductor support 208, is fabricated or molded as a single piece out of a suitable nonconductive material, e.g., plastic, ceramics, or any other suitable material.

When base 202 is coupled with the underlying circuit board, the apertures in the conductor supports align with apertures in the circuit board to permit conductors to be inserted through both base 202 and the underlying circuit board. For example, aperture 210 is aligned with an aperture in the circuit board when base 202 is screwed onto the circuit board (via screw holes 220 and 222). There is shown adjacent to aperture 210 a rib 224 disposed in a direction perpendicular to the circuit board when base 202 is coupled to the circuit board (e.g., protruding out of the page in FIG. 2). Rib 224 is configured to permit the conductor that is disposed in aperture 210 to lie against rib 224, thereby providing support to at least one side of the conductor. To improve rigidity, rib 224 is provided with rib supports 226, of which two are shown. Rib support 226 are optional, and any number of rib support 226 may be provided with rib 224 as needed to prevent rib 226 from undue flexing as the conductor which it supports is flexed. If rib 224 is sufficiently rigid, rib support 226 may not be necessary and may be omitted in one embodiment.

Tab 204 is configured for mating with conductor support 206, and includes a top portion 250 and a retainer portion for preventing tab 204, once mated with conductor support 206, from inadvertently becoming unmated. In the example of FIG. 2, the retainer portion includes two hook 252(*a*) and 252(*b*) for hooking into corresponding depressions in conductor support 206. However, the retainer portion may comprise any other well known structures for keeping tab 204 mated with conductor support 206, e.g., fasteners or any other retaining structures. The retainer portion may be omitted altogether, in one embodiment, if it is ascertained that tab 204 is reasonably secure once mated with conductor support 206 (e.g., via pressure therebetween), and that the probability of tab 204 becoming unmated is sufficiently remote even without the use of a retaining structure.

When tab 204 is inserted into conductor support 206, an edge 254 of top portion 250 is disposed adjacent to the conductor disposed in aperture 210, thereby permitting edge 254 to immobilize the conductor between edge 254 and rib 224 of conductor support 206. Top portion 250 includes optional nubs 256 (of which two are shown although the number may vary). Nubs 256 allow a portion of the conductor to be tightly held between edge 254 (of tab 204) and rib 224 during solder wave and during use, while permitting tab 204 to be easily inserted into and/or removed from conductor support 206. Nubs 256 are optional and may be replaced by any suitable structure for applying pressure against the conductor when tab 204 is inserted into conductor support 206, e.g., a wedge shape structure. In one embodiment, nubs 256 may be omitted altogether.

If a second conductor is disposed in conductor support 206, e.g., in aperture 212, edge 257 of tab 204 is disposed adjacent to the conductor disposed in aperture 212, thereby permitting edge 257, which is opposite to edge 254 on tab 204, to immobilize the conductor between edge 257 and rib 264 of conductor support 206. As with rib 224, rib 264 may be provided with optional rib supports 266 to improve rigidity. Optional nubs 258, which are analogous to nubs 254) may also be provided to improve gripping of the conductor and/or to facilitate easy insertion and/or removal of tab 204.

When tab 204 is inserted into conductor support 206, hook 252(*a*) couples with a corresponding hook receiving portion 260(*a*) associated with conductor support 206, and hook 252(*b*) couples with a corresponding hook receiving portion 260(*b*) associated with conductor support 206. Of course hook receiving portions 260(*a*) and 260(*b*) may be omitted if hooks 252(*a*) and 252(*b*) are deemed, as discussed earlier, unnecessary for immobilizing the conductor disposed in conductor support 206.

To further ensure that tab 204 and conductor support 206 immobilize the conductor therebetween sufficiently, tab 204 includes an optional post 270, which is fitted in hole 272 of conductor support 206 when tab 204 is mated with conductor support 206. As with optional hooks 252(*a*) and 252(*b*), optional post 270 may be omitted if tab 204 and conductor support 206 are capable of holding the conductor portion disposed therebetween substantially immobile when the remainder of the conductor is flexed, e.g., via pressure or other conventional retaining technique.

Figure 3:
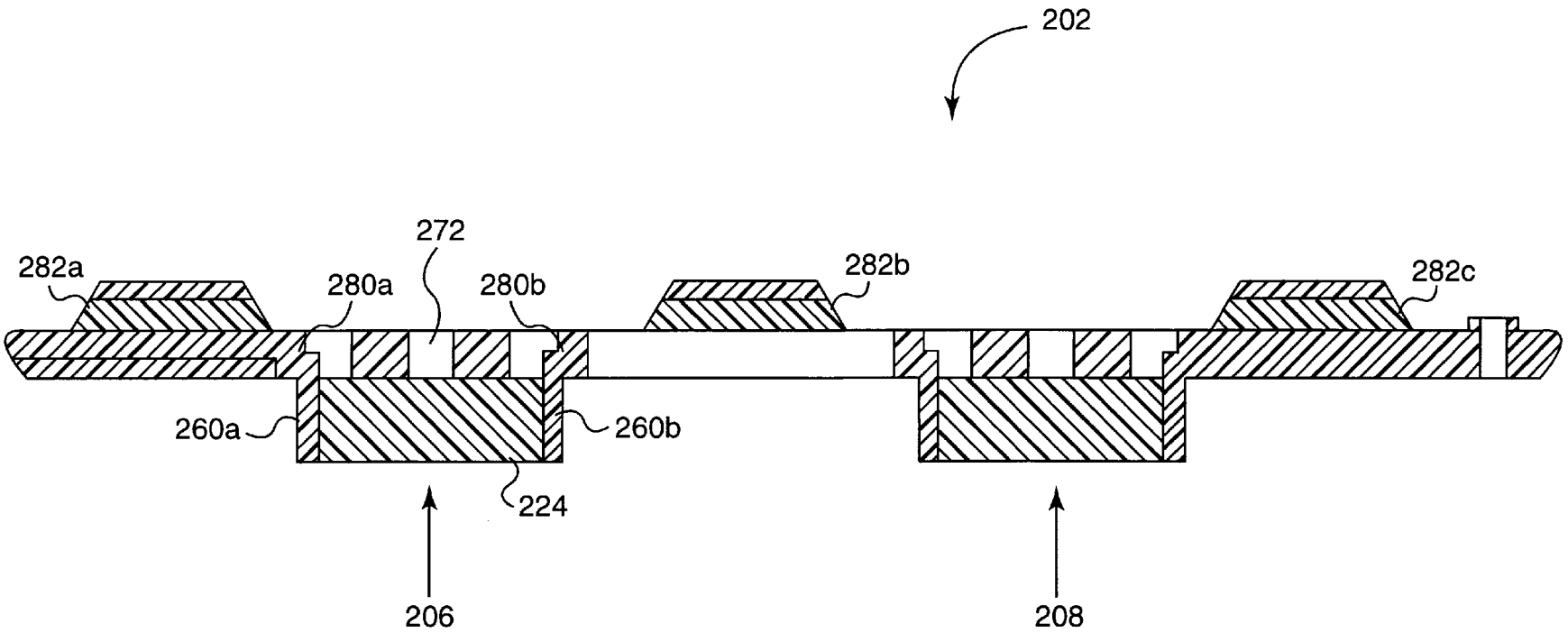
FIG. 3 illustrates, in accordance with one embodiment of the present invention, a side view of the base portion of FIG. 2 along line A—A.

FIG. 3 illustrates a side view of base 202 along line A—A of FIG. 2, including conductor support 206 and conductor support 208, in accordance with one embodiment of the present invention. To facilitate ease of comprehension, components having substantially similar functions are referenced using the same reference number throughout the figures herein. Rib 224 and hole 272, which have been described in connection with FIG. 2, are also shown.

There are further shown in FIG. 3, notches 280(*a*) and 280(*b*) in respective hook receiving portions 260(*a*) and 260(*b*) for accepting hooks 252(*a*) and 252(*b*). In one embodiment, either hook receiving portions 260(*a*)/260(*b*) or hooks 252(*a*)/252(*b*) may be configured to abut against the conductor to constraint the conductor against forces that flex the conductor along the face of rib 224.

Additionally, there are shown optional base retainers 282(*a*), 282(*c*), and 282(*c*) for clipping base 202 to the edge of the underlying circuit board. Base retainer 282(*a*) is more clearly shown in FIG. 4, which illustrates, in accordance with one embodiment of the present invention, a side view of base 202 along line B—B of FIG. 2.

Figure 5:
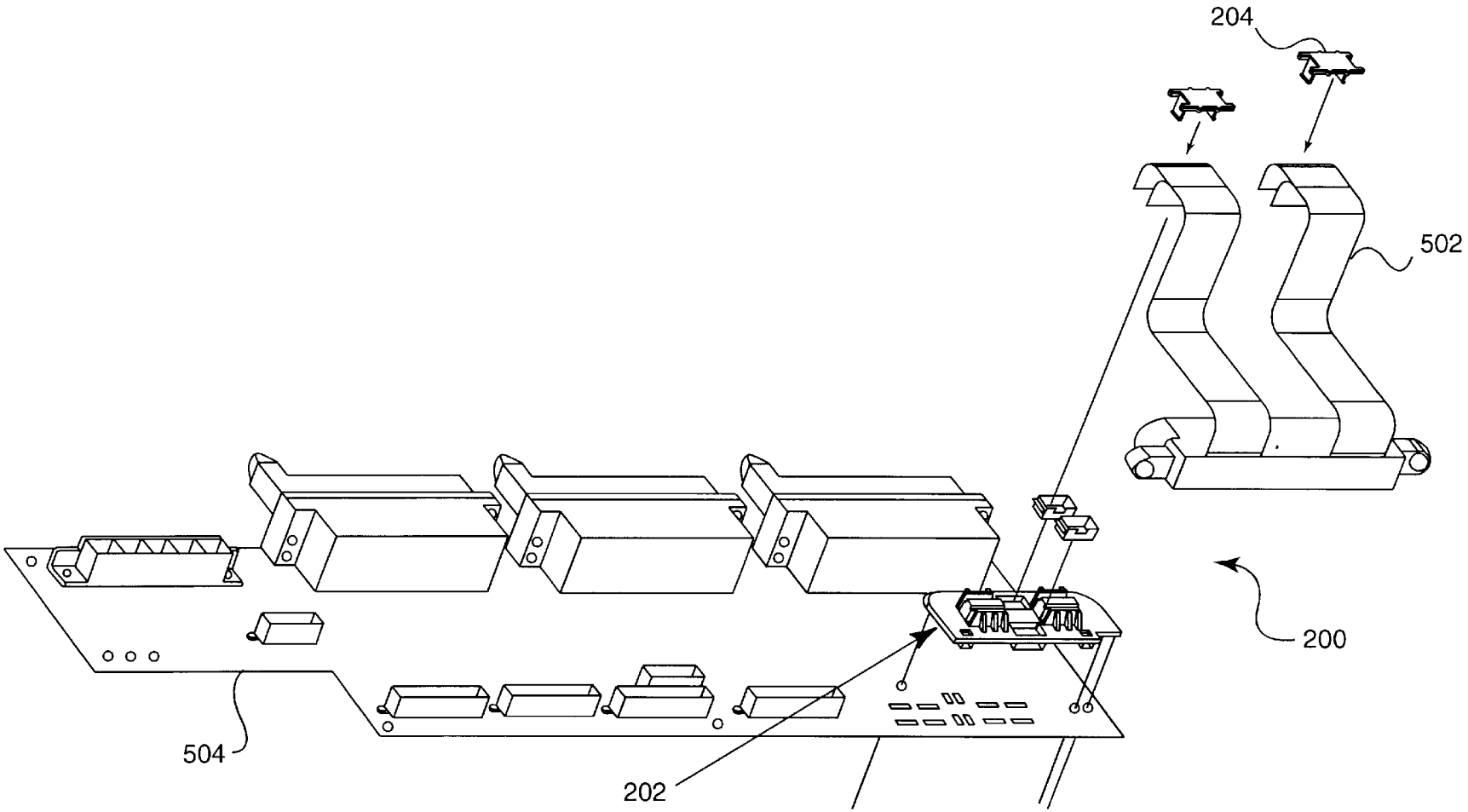
FIG. 5 illustrates, in accordance with an embodiment of the present invention, an exploded view of the strain relief apparatus of FIG. 2 as shown with conductors and a circuit board.
Figure 6:
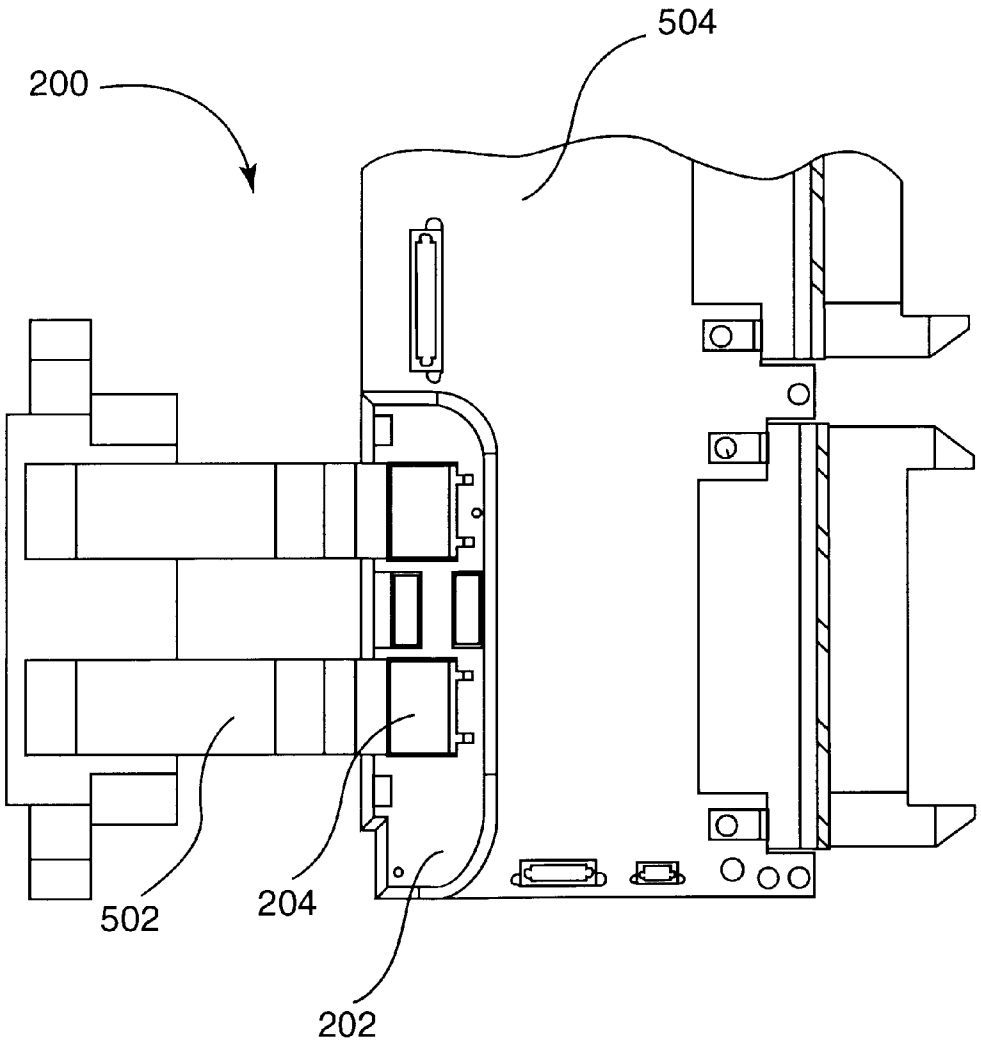
FIG. 6 illustrates, in accordance with an embodiment of the present invention, an isometric view of the strain relief apparatus of FIG. 5 as connected to the conductors and the circuit board.

FIG. 5 is an exploded view of strain relief apparatus 200 of FIG. 2 in accordance with an embodiment of the present invention. Specifically, base 202, tab 204, and a conductor 502 are shown prior to assembly onto a circuit board 504. FIG. 6 is a diagrammatic representation of strain relief apparatus 200, as shown in FIG. 5, coupled to circuit board 504 in accordance with an embodiment of the present invention.

Figure 4:
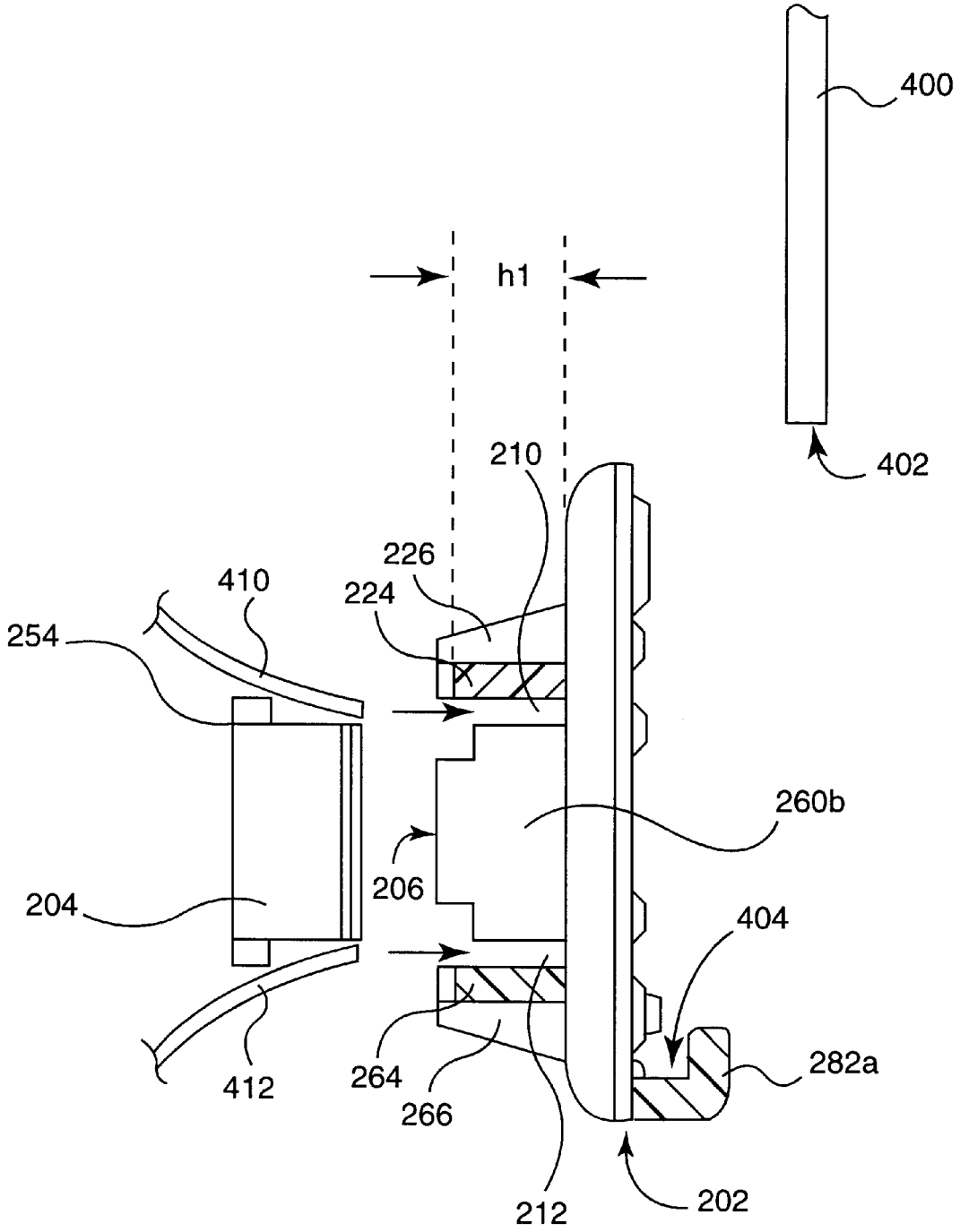
FIG. 4 illustrates, in accordance with one embodiment of the present invention, a side view of the base portion of FIG. 2 along line B—B.

With reference to FIG. 4, base 202 may be clipped to an edge 400 of circuit board 400 using base retainer 282(*a*) such that edge 400 fits into space 404 of base retainer 282(*a*). Base 202 may then be positioned along edge 402, guided by base retainer 282(*a*), until the apertures in the conductor supports (e.g., aperture 210 in FIG. 2), line up with corresponding apertures in circuit board 400. In this manner, base retainers 282 acts both as a positioning guide during the installation of base 202 to circuit board 400 and as a retaining structure for improve mating between base 202 and circuit board 400. Of course base retainers 282 are optional and may be omitted if desired in one embodiment.

FIG. 4 further shows conductor 410 (along its narrow edge), which is configured for insertion into apertures in base 202 and circuit board 400 (as discussed in connection with FIG. 2) and being supported against rib 224 of base 202. A portion of conductor 410 is held immobile against rib 224 when tab 204 (discussed in connection with FIG. 2) is mated with conductor support 206 of base 202. Preferably, the height h1 of rib 224 is properly sized to permit the portion of the conductor that is rendered brittle by the heat of the soldering process to be captured within base 202 when tab 204 (discussed earlier in connection with FIG. 2 and omitted in FIG. 4 to improve clarity) is inserted into conductor support 206. In one embodiment, conductor 410 may be configured to have separate multiple leaves in its distal end, e.g., the end to be soldered. These multiple leaves may then be inserted into separate adjacent apertures in the circuit board to allow the coupling between conductor 410 and board 400 to be strengthened after soldering, e.g., against forces which flex conductor 410 along the face of rib 224.

A second conductor 412 is also shown, configured for insertion into base 202 and being supported against rib 264. When tab 204 is mated with conductor support 206, tab 204 is disposed between the opposing faces of ribs 224 and 264 and supports conductors 410 and 412 by clamping these conductors between their adjacent ribs (e.g., ribs 224 and 264) and tab 204.

As mentioned earlier, conductor 412 and rib 264 are optional and may be omitted if conductor support 264 is configured to provide strain relief support to only a single conductor, e.g., conductor 410. Of course if rib 264 is omitted, a suitable structure opposing rib 224 is desirable to allow tab 204 to exert a proper amount of pressure against conductor 410 (and rib 224) when tab 204 is mated with conductor support 206.

The distal ends of conductor 410, i.e., the end away from circuit board 400, may be coupled to a plug to permit conductor 410, and board 400 to which it is coupled, to be quickly decoupled from another board and/or other circuits of the electronic system. Since the brittle portion of conductor 410 is held immobile by the inventive strain relief apparatus comprising base 202 and tab 204, conductor 410 may be flexed as necessary during use without risks of premature conductor breakage.

In one embodiment, circuit board 400 is employed as a power distribution board in a computer system. In such a power distribution board, conductor 410 may represent an insulated conductive metal band for supplying various voltages to other portions of the electronic system, e.g., Mylar™ covered band of copper, aluminum, or an alloy thereof As solid conductive bands are particularly susceptible to breakage when annealed by the heat of the soldering process, the invention is particularly useful for extending the useful life of boards employed such conductive metal bands. Conductor 410 may be provided with a plug at its distal end to permit conductor 410 to be quickly coupled with a plug on another board, e.g., the computer logic board. When so configured, the computer logic board may be easily and quickly coupled from and decoupled to the power distribution board to which conductor 410 is soldered without risks of premature conductor breakage.

As can be appreciated from the foregoing, the invention provides an efficient, inexpensive, and easy to use strain relief apparatus that allows the portion of the conductor that has been rendered brittle by the soldering process to be held substantially immobile during wave solder and/or use.

Accordingly, the potentiality for premature conductor breakage is substantially reduced as the conductor is flexed during use.

As noted, the inventive strain relief apparatus may further be employed as a wave solder fixture, which keeps the conductor fixed to the board during wave soldering. Advantageously, the inventive strain relief apparatus remains fixed to the circuit board after wave soldering to permit it to perform its strain relief function during use. In this manner, wave soldering is substantially simplified as a separate fixture is not necessary to hold the conductors, which tend to be heavy and unbalanced prior to being soldered to the board, from slipping out as the board goes through the wave solder machine.

While this invention has been described in terms of several preferred embodiments, there are alterations, permutations, and equivalents which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. An apparatus for securing a conductor to a circuit board, said conductor being configured for being soldered to said circuit board, the apparatus comprising:

a conductor supporting portion having a second aperture defined therethrough, said conductor supporting portion being configured for coupling to said circuit board, said second aperture further being arranged to be substantially aligned with a first aperture defined within said circuit board when said conductor supporting portion is coupled to said circuit board to permit said conductor to be inserted through both said first aperture and said second aperture; and a tab portion configured to be coupled to said conductor supporting portion, the tab portion including a first edge that is arranged to contact the conductor, said first edge of said tab portion and said conductor supporting portion being arranged to hold a first portion of said conductor substantially immobile between said conductor supporting portion and said first edge of said tab portion when said tab portion is coupled with said conductor supporting portion, thereby preventing said conductor from being broken at said first portion of said conductor when said conductor is flexed, wherein said tab portion includes a support post, said support post being configured for insertion into a support post receiving aperture in said conductor supporting portion to reduce a relative motion between said conductor supporting portion and said tab portion when said conductor is flexed.

2. The apparatus of claim 1 wherein said first portion of said conductor represents a portion susceptible to breakage when said conductor is flexed, said first portion being rendered susceptible to said breakage by a soldering operation employed to solder said conductor to said circuit board.

3. The apparatus of claim 1 wherein said tab portion includes a nub disposed at said first edge of said tab portion, said nub being configured for contacting said conductor when said tab portion is coupled to said conductor supporting portion to hold said conductor between said nub and said conductor supporting portion.

4. The apparatus of claim 1 wherein said conductor supporting includes a third aperture therethrough for supporting an additional conductor, said third aperture being substantially aligned with a fourth aperture in said circuit board to permit said additional conductor to be inserted through both said third aperture and said fourth aperture and supported between said conductor supporting portion and a second edge of said tab portion when said tab portion is coupled to said conductor supporting portion, said second edge being opposite said first edge of said tab portion.

5. The apparatus of claim 1 wherein said conductor supporting portion includes a rib, said rib being disposed in a direction perpendicular to said circuit board to allow said conductor, when disposed in said first aperture and said second aperture, to be held between said rib and said first edge of said tab portion.

6. The apparatus of claim 1 wherein said conductor represents a conductive metal band and said second aperture is configured for receiving said conductive metal band.

7. The apparatus of claim 1 wherein said tab portion includes a hook portion, said conductor supporting portion including a hook receiving structure arranged to be coupled to said hook portion when said tab portion is coupled to said conductor supporting portion.

8. The apparatus of claim 7 wherein said portion of said conductor represents a portion susceptible to breakage when said conductor is flexed, said portion being rendered susceptible to said breakage by a soldering operation employed to solder said conductor to said circuit board.

9. A method for reducing breakage to a conductor when said conductor is flexed, said conductor being configured for being soldered to a circuit board in said circuit board, the method comprising:

coupling a conductor supporting portion to said circuit board, said conductor supporting portion having a second aperture defined therethrough, wherein said second aperture is arranged to be substantially aligned with a first aperture defined within said circuit board when said conductor supporting portion is coupled to said circuit board:

inserting said conductor through said first aperture and through said second aperture; and coupling a tab portion to said conductor supporting portion, said tab portion including a first edge, wherein a first portion of said conductor is held substantially immobile between said conductor supporting portion and said first edge of said tab portion when said tab portion is coupled with said conductor supporting portion thereby preventing said conductor from being broken at said first portion of said conductor when said conductor is flexed, wherein said tab portion includes a nub disposed at said first edge of said tab portion, said nub being configured for contacting said conductor when said tab portion is coupled to said conductor supporting portion to hold said conductor between said nub and said conductor supporting portion.

10. The method of claim 9 wherein said first portion of said conductor represents a portion susceptible to breakage when said conductor is flexed, said first portion being rendered susceptible to said breakage by a soldering operation employed to solder said conductor to said circuit board.

11. The method of claim 9 wherein said coupling said tab portion to said conductor supporting portion includes inserting a support post in said tab portion into a support post receiving aperture in said conductor supporting portion to reduce a relative motion between said conductor supporting portion and said tab portion when said conductor is flexed.

12. The method of claim 9 wherein said coupling said tab portion to said conductor supporting portion includes coupling a hook portion in said tab portion with a hook receiving structure in said conductor supporting portion to prevent said tab portion from being inadvertently uncoupled from said conductor supporting portion.

13. The method of claim 9 wherein said conductor supporting includes a third aperture therethrough for supporting an additional conductor, said third aperture being substantially aligned with a fourth aperture in said circuit board to permit said additional conductor to be inserted through both said third aperture and said fourth aperture and supported between said conductor supporting portion and a second edge of said tab portion when said tab portion is coupled to said conductor supporting portion, said second edge being opposite said first edge of said tab portion.

14. The method of claim 9 wherein said conductor supporting portion includes a rib, said rib being disposed in a direction perpendicular to said circuit board to allow said conductor, when disposed in said first aperture and said second aperture, to be held between said rib and said first edge of said tab portion.

15. The method of claim 9 wherein said portion of said conductor represents a portion susceptible to breakage when said conductor is flexed, said portion being rendered susceptible to said breakage by a soldering operation employed to solder said conductor to said circuit board.

16. An apparatus for securing a conductor to a circuit board, said conductor being arranged to be soldered to said circuit board, the apparatus comprising:

first conductor support means having a second aperture therethrough, wherein said second aperture is arranged to be substantially aligned with a first aperture defined within said circuit board when said first conductor support means is coupled to said circuit board; and second conductor support means configured for coupling to said first conductor support means, said second conductor support means including a first edge, wherein a first portion of said conductor is held substantially immobile between said first conductor support means and said first edge of said second conductor support means when said second conductor support means is coupled with said first conductor supporting means, thereby preventing said conductor from being broken at said first portion of said conductor when said conductor is flexed, wherein said second conductor support means includes a means for reducing a relative motion between said first conductor support means and said second conductor support means, said means for reducing said relative motion being configured for being coupled to a corresponding receiving means in said first conductor support means when said second conductor support means is coupled to said first conductor support means.

17. The apparatus of claim 16 wherein said first portion of said conductor represents a portion susceptible to breakage when said conductor is flexed, said first portion being rendered susceptible to said breakage by a soldering operation employed to solder said conductor to said circuit board.

18. The apparatus of claim 16 wherein said second conductor support means includes means for preventing said second conductor support means from being inadvertently uncoupled from said first conductor support means when said second conductor support means is coupled to said first conductor support means.

19. The apparatus of claim 16 wherein said first conductor support means includes conductor contacting means disposed in a direction perpendicular to said circuit board, said conductor contacting means allowing said conductor, when disposed in said first aperture and said second aperture, to be held between said conductor conducting means and said first edge of said second conductor support means.

* * * * *